US007420512B2

(12) United States Patent
Lannon et al.

(10) Patent No.: US 7,420,512 B2
(45) Date of Patent: Sep. 2, 2008

(54) ANTENNA SYSTEM

(75) Inventors: Matthew Lannon, Dracut, MA (US); Clyde Callewaert, Shelby Township, MI (US)

(73) Assignee: M/A-COM, Inc., Lowell, MA (US)

( * ) Notice: Subject to any disclaimer, the term of this patent is extended or adjusted under 35 U.S.C. 154(b) by 336 days.

(21) Appl. No.: 11/195,306

(22) Filed: Aug. 2, 2005

(65) Prior Publication Data

US 2007/0080809 A1 Apr. 12, 2007

(51) Int. Cl.
*H01Q 1/38* (2006.01)
*G08B 13/14* (2006.01)

(52) U.S. Cl. ..... 343/700 MS; 340/572.1

(58) Field of Classification Search ..... 343/700 MS, 343/702, 872, 87; 340/572.1
See application file for complete search history.

(56) References Cited

U.S. PATENT DOCUMENTS

| | | | | |
|---|---|---|---|---|
| 6,184,841 | B1 | 2/2001 | Shober et al. | 343/853 |
| 6,215,402 | B1 * | 4/2001 | Rao Kodukula et al. | 340/572.8 |
| 6,255,993 | B1 | 7/2001 | Greeff et al. | 343/700 |
| 6,281,794 | B1 * | 8/2001 | Duan et al. | 340/572.1 |
| 6,683,570 | B2 | 1/2004 | Skladany et al. | 343/700 |
| 7,023,342 | B2 * | 4/2006 | Corbett et al. | 340/572.1 |
| 7,068,224 | B2 * | 6/2006 | Carrender et al. | 343/700 MS |
| 2003/0160725 | A1 | 8/2003 | Baxter et al. | 343/702 |

FOREIGN PATENT DOCUMENTS

| | | |
|---|---|---|
| EP | 0 301 580 | 2/1989 |
| EP | 0 434 268 | 6/1991 |
| EP | 0 516 440 | 12/1992 |
| WO | WO 97/43799 | 11/1997 |
| WO | WO 03/034349 | 4/2003 |
| WO | WO 2004/017462 | 2/2004 |

OTHER PUBLICATIONS

Declaration by Stephen J. Driscoll dated Dec. 30, 2005 including photographs of the ThingMagic RFID antenna system.
Dan Handelsman, How do patch antennas work? Apr. 16, 2002 (http://www.antennaex.com/storage/_atheory/000000f6.htm).
RFID Journal, RFID Technology, How does an RFID system work? (http://www.rfidjournal.com/faq/17/58).
Radio Frequency Identification (RFID) from Wikipedia (http://en.wikipedia.org/wiki/RFID), Jan. 31, 2005.

* cited by examiner

*Primary Examiner*—Shih-Chao Chen

(57) ABSTRACT

An antenna system for a radio frequency identification system comprising: (a) a base; (b) a first patch antenna disposed on the base and having a circular polarization and adapted to convert between electrical signals and electromagnetic fields; and (c) a second patch antenna disposed on the base and having a circular polarization and adapted to convert between electrical signals and electromagnetic fields, the second antenna being disposed at a distance from the first antenna to define a region between the first and the antenna, the second patch antenna being positioned relative to the first patch antenna such that the electromagnetic fields of the two antennas are substantially opposing in the region.

19 Claims, 5 Drawing Sheets

ANTENNA SYSTEM

FIELD OF INVENTION

This invention relates to wireless communication systems and, more particularly, to antenna technology used in a radio frequency identification communication system.

BACKGROUND OF INVENTION

Radio-frequency identification (RFID) systems are well-known and used for identifying and/or tracking equipment, inventory, or living things. Basically, an RFID system is a radio communication system comprising a radio transceiver, referred to herein as an interrogator, and a number of inexpensive devices called tags or transponders. Conventional RFID systems are designed to read the information contained on a tag when it passes within range of an interrogator. This type of system is called a passive system because information is only read from the tag and not written to it. Another type of RFID system is called an active system. This type of system is one in which an interrogator can both read the data on a tag as well as write new information or overwrite existing information on the tag when it passes within the range of the interrogator. RFID systems are described, for example, in U.S. Pat. Nos. 6,255,993 and 6,184,841.

In a typical RFID system, the interrogator communicates to the tags using modulated radio signals, and the tags respond with modulated radio signals. A common RFID system is a modulated backscatter (MBS) system. In an MBS system, after transmitting a message to the tag (called the downlink), the interrogator then transmits a continuous-wave (CW) radio frequency (RF) signal to the tag. The tag then modules this CW RF signal in accordance with data specific to the tag and transmits it back to the interrogator. Therefore, modulated backscatter allows communications from the tag back to the interrogator (called the uplink). Another type of RFID system uses an active uplink (AU). In an AU system, the RFID tag does not modulate and reflect an incoming CW signal, but rather synthesizes an RF carrier, modulates that RF carrier, and transmits that modulated carrier to the interrogator. In some AU systems, the RF carrier used in the uplink is at or near the same frequency as that used in the downlink, while in other AU systems, the RF carrier used in the uplink is at a different frequency than that used in the downlink.

An important component of an RFID system is the antenna system located in the interrogator. The antenna system functions to convert data between electrical signals and electromagnetic radiation, To this end, a typical RFID system comprises a transmitting antenna which converts electrical signals to electromagnetic fields of a certain pattern on the surface of the antenna to facilitate electromagnetic, or, more specifically, RF, radiation, and a receiving antenna which absorbs RF radiation to create electromagnetic fields on its surface and convert these fields back into electrical signals.

As with most electronics, there is a need to miniaturize RFID systems to save space and cut cost without sacrificing performance. Miniaturizing the antenna system of an RFID system, however, has proven difficult since isolation between the transmit and receive antennas, which is critical for good performance, tends to be compromised as the antenna are moved closer together. One approach for improving isolation between closely-mounted antennas involves using a partition between them. For example, the antenna systems sold by ThingMagic (Cambridge, Mass.) and Symbol (formerly Matrics of Columbia, Md.) have adequate isolation between the antennas, but use a partition between the antennas which consumes valuable space and therefore contravenes the objective of miniaturization.

Therefore, there is a need for an RFID antenna system that facilitates miniaturization while maintaining good isolation. The present invention fulfills this need among others.

SUMMARY OF INVENTION

The present invention provides an antenna system applicable to, but not limited to, a radio frequency identification (RFID) system, which enables the transmit and receive antennas to be closely positioned while maintaining good isolation. To this end, the system exploits destructive interference between the antennas such that their electromagnetic fields are opposing in the region separating them. Further, it has been found that this destructive interference may be achieved readily and reliably by locating the feed points of the antennas in opposing positions. Thus, by exploiting destructive interference between the antennas, the antennas may be positioned relatively close together without the need for partitions or other means of isolating the antennas.

Accordingly, one aspect of the invention is an antenna system applicable to, but not limited to, an RFID system in which the electromagnetic fields of the antennas are interfering in the region between the antennas. In a preferred embodiment, the system comprises (a) a base; (b) a first patch antenna disposed on the base and having a circular polarization and adapted to convert between electrical signals and electromagnetic fields; and (c) a second patch antenna disposed on the base and having a circular polarization and adapted to convert between electrical signals and electromagnetic fields, the second antenna being disposed at a distance from the first antenna to define a region between them, the second patch antenna being oriented relative to the first patch antenna such that the electromagnetic fields of the two antennas are substantially opposing in the region.

In another preferred embodiment, the antenna system comprises: (a) a base; (b) a first patch antenna mounted on the base and comprising a first circular surface capable of transmitting a circularly polarized signal, the first patch antenna comprising a first feed point at a first position within the first circular surface; and (c) a second patch antenna mounted on the base comprising a second circular surface capable of receiving a return signal from a tag, the second circular surface being about the same size as the first circular surface, the second patch antenna comprising a second feed point in a second position on the second circular surface, the first and second positions being essentially opposing.

Another aspect of the invention is an RFID system which uses the antenna system described above. In a preferred embodiment, A RFID system comprising: (a) a controller; (b) an interrogator communicatively linked to the controller and comprising at least a transmitter, a receiver, and an antenna system; and (c) the antenna system comprising at least: (i) a housing; (ii) a first antenna mounted in the housing and connected to the transmitter, the first antenna comprising a first circular surface capable of transmitting a circularly polarized signal to a tag, and a feed point in a first position within the first circular surface; and (iii) a second antenna mounted on the base and connected to the receiver, the second antenna comprising a second circular surface capable of receiving a return signal from a tag, the second circular surface being about the same size as the first circular surface, the second antenna comprising a feed point in a second position within the second circular surface, the second position being essentially opposed to the first position.

DETAILED DESCRIPTION OF PREFERRED EMBODIMENT

Figure 1:
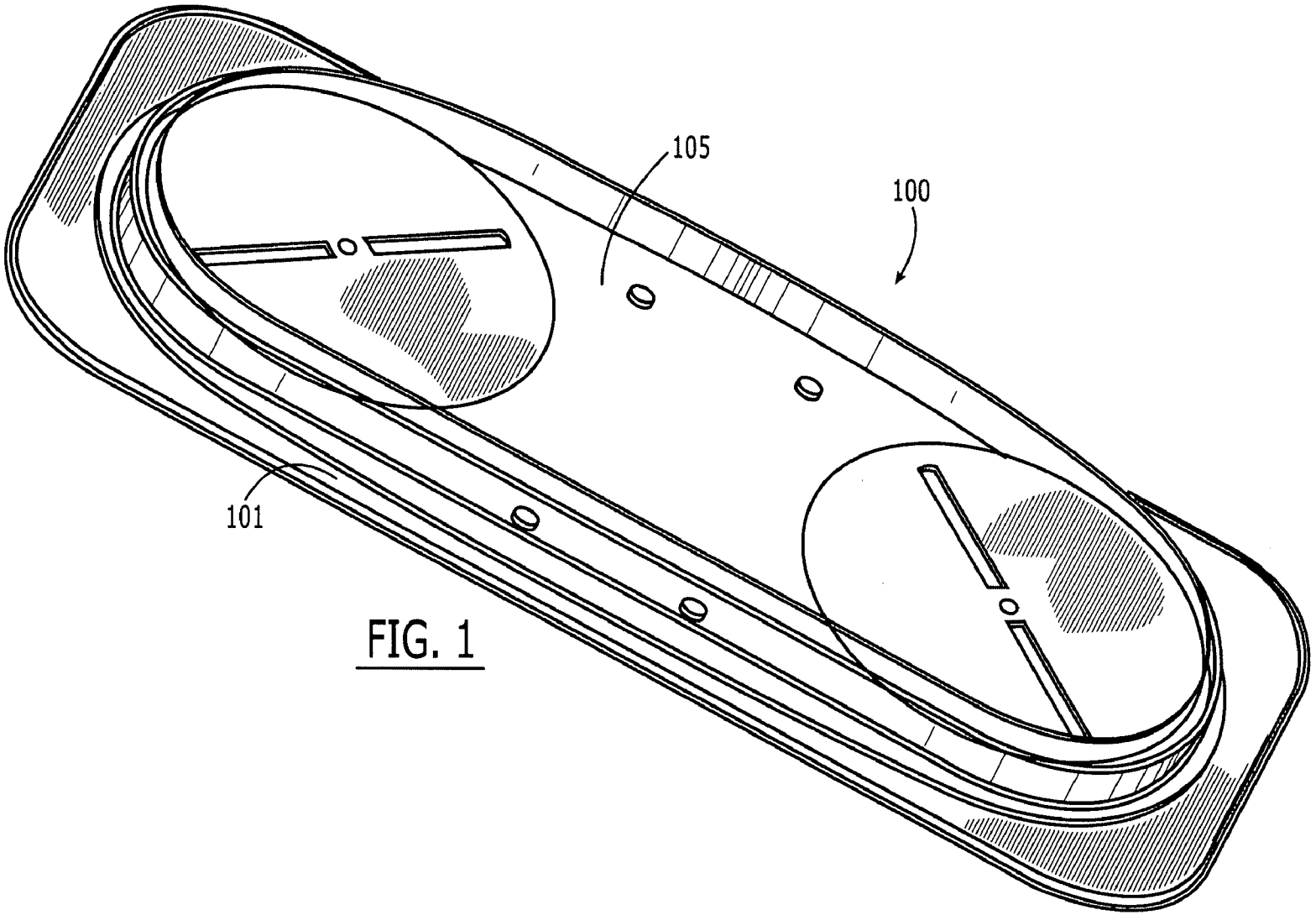
FIG. 1 shows antenna system of the present invention revealing the antenna base within the housing.
Figure 2:
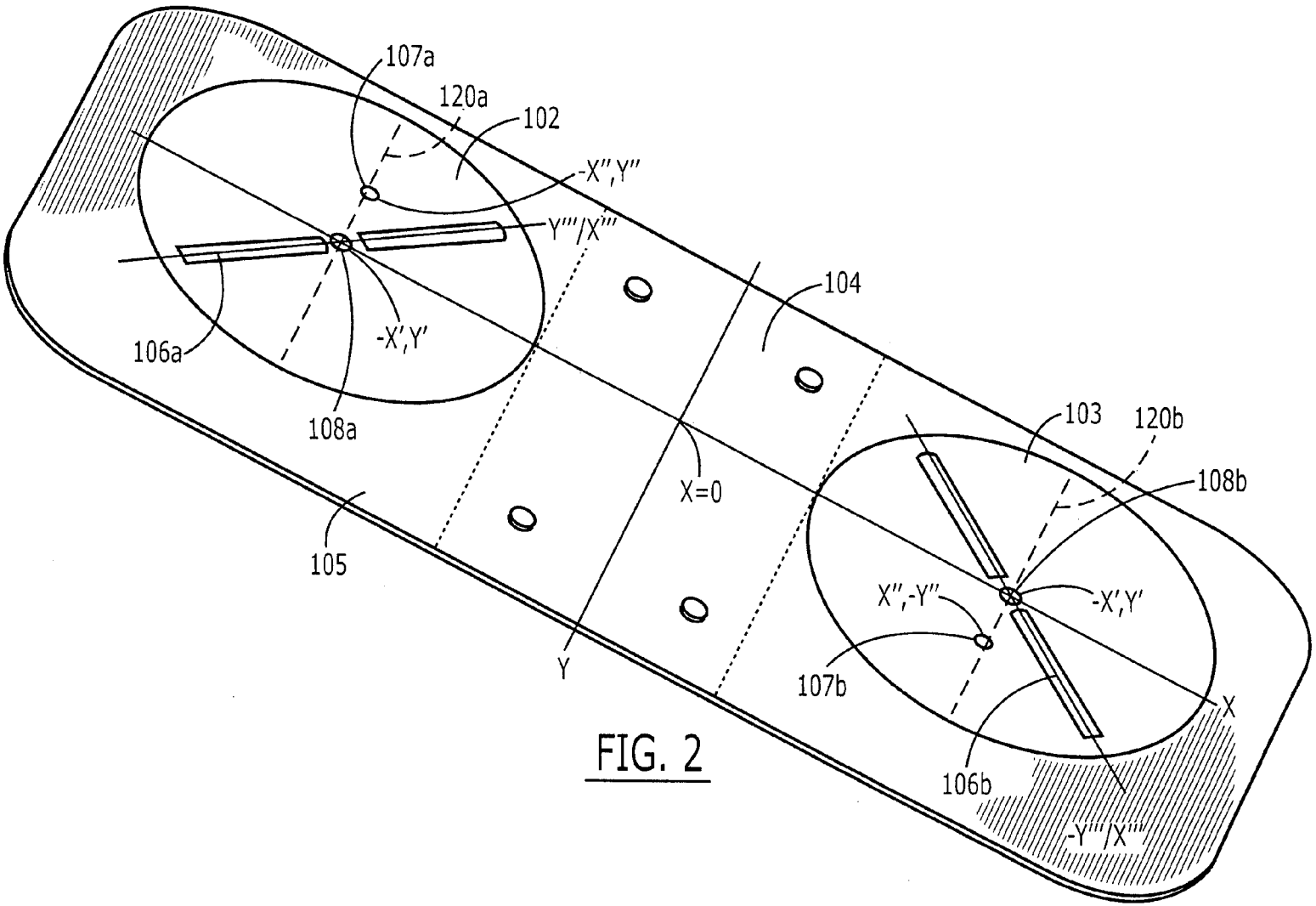
FIG. 2 shows the antenna base for the system of FIG. 1.

Referring to FIGS. 1 and 2, a preferred embodiment of an antenna system 100 of the present invention is shown for a radio frequency identification (RFID) system. The antenna system 100 comprises a housing 101 which contains an antenna base 105 on which first and second patch antennas 102, 103 are mounted. The first and second patch antennas 102, 103 have a circular polarization and are adapted to convert a signal between electrical current and electromagnetic fields. The second patch antenna 103 is disposed at a distance from the first antenna to define a region 104 between the first and the antenna (demarcated by dotted lines in FIG. 2). The patch antennas are positioned relative to each other such that the electromagnetic fields of the two antennas are substantially opposing in the region 104.

A critical aspect of the present invention is the opposing electromagnetic fields in the region between the antennas. As used herein, the terms "opposing electromagnetic fields", "opposing electric and magnetic fields", or just "opposing fields" are used to refer to the electromagnetic fields of the antennas which destructively interfere rather than constructively interfere. Constructive interference and destructive interference are well known concepts in electromagnetics. Briefly, constructive interference of fields results in their coupling which increases the magnitude of the fields in the area of interference. On the other hand, destructive interference of fields results in the fields not coupling but rather counteracting each other to diminish the magnitude of the fields in the area of interference. It is generally recognized that fields are destructively interfering if their direction vectors differ by 180°±90°.

The destructive/constructive interference of the electromagnetic fields of the antenna system 100 can be evaluated through an analysis of the power densities or magnitudes of the electric and magnetic fields between the antennas. Referring to FIGS. 3(*a*)-(*b*) and 4(*a*)-(*b*), the magnitudes of the electric and magnetic fields, respectively, are shown. Such graphical representations are well known in the field and can be generated using a high frequency structure simulator (HFSS), which is commercially available from, for example, Ansoft Corp. (Pittsburgh, Pa.). In these particular figures, the relative strengths are shown in gray scale with the darker grays corresponding to weaker fields.

Figure 3A:
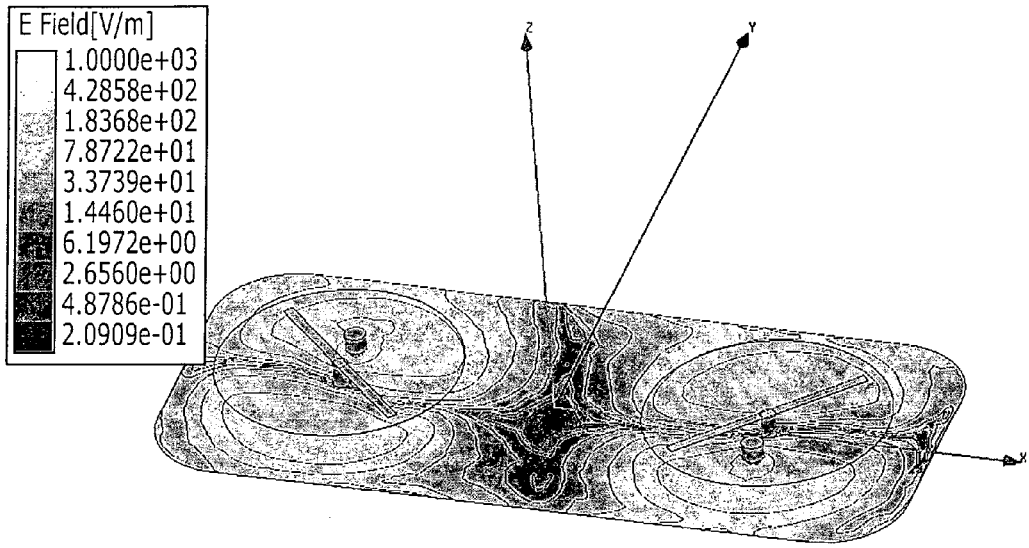
FIGS. 3(*a*) and 3(*b*) show electric field magnitude patterns for different antenna configurations.
Figure 3B:
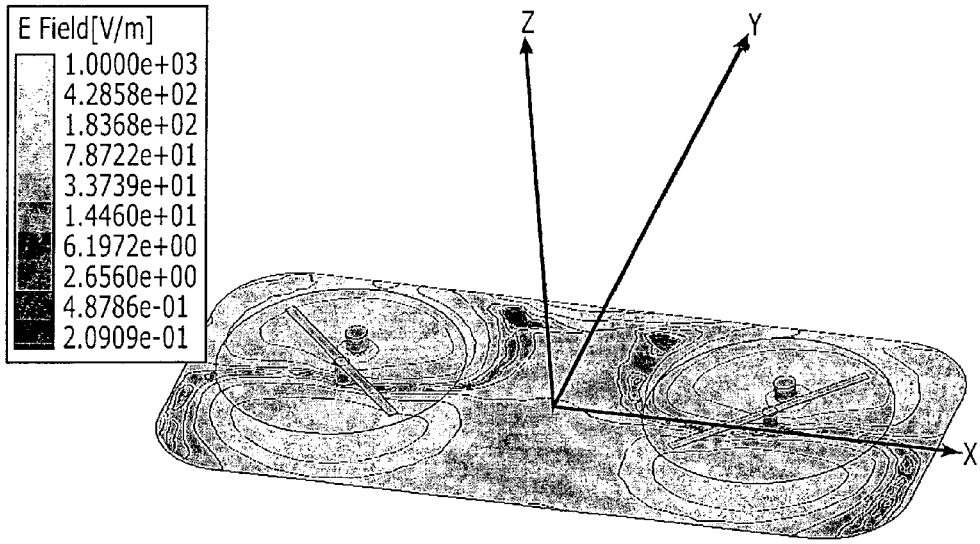

FIGS. 3(*a*)-(*b*) show the magnitudes of the electric fields of the antenna system for two different antenna configurations. FIG. 3*a* shows a preferred embodiment of the antenna system in which the feed points are opposing (discussed in detail below) and, for comparative purposes, FIG. 3*b* shows an antenna system in which the feed points are in the same position. Referring to FIG. 3*a*, it is clear that the magnitude of the electric fields around the antennas diminishes as the distance from the antennas increases. It is significant, however, that the magnitude of the electric field drops precipitously in the region between the antennas as indicated by the dark shading. This is significant since such a precipitous decline in field strength must be the result of destructive interference, rather than the mere diminution of field strength as a function of distance from its source.

Referring to FIG. 3(*b*), when the feed points are rearranged relative to the slot, there is not a precipitous decline in the electric field strength in the region between the antennas. To the contrary, field strength remains essentially the same across the region even as the distance from each antenna increases. Such a pattern is consistent with constructive interference of the electric fields of the two antennas. In other words, rather than diminishing as a function of distance from each antenna, the field in the region between the antennas remains relatively constant as the two fields combine or couple.

Figure 4A:
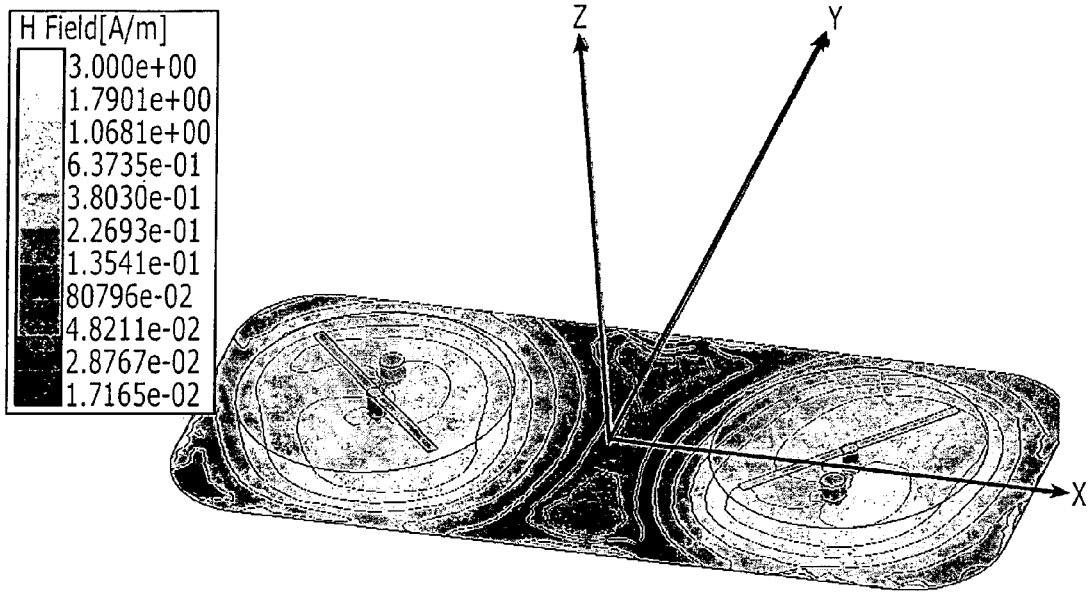
FIGS. 4(*a*) and 4(*b*) show magnetic field magnitude patterns for different antenna configurations.
Figure 4B:
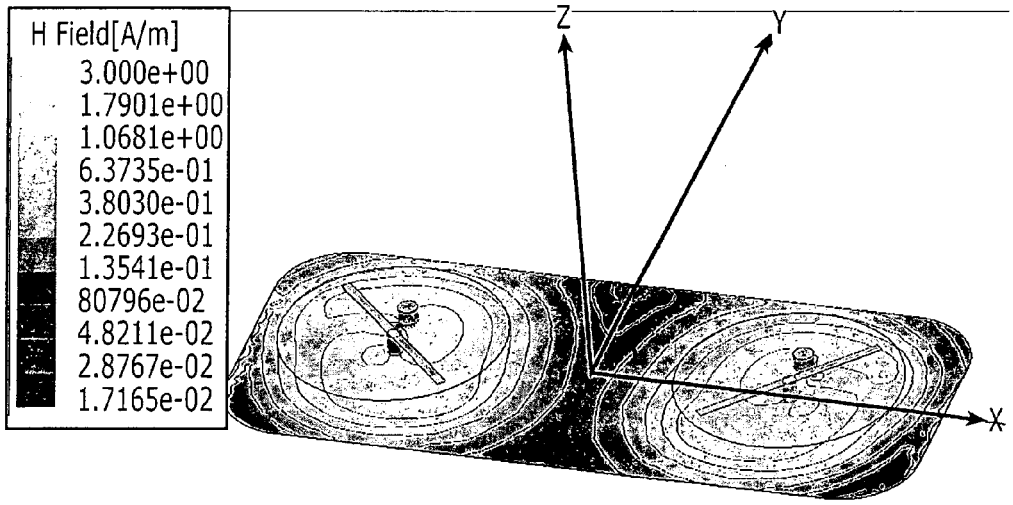

Referring to FIGS. 4*a* and 4*b*, patterns of the magnetic fields, which are similar to those of the electric fields, are shown. Specifically, with respect to FIG. 4*a*, the magnetic fields of the antenna system 100 are shown for a system having opposing feed points (as in FIG. 3*a*). The magnetic fields diminish in magnitude as a function of distance from their respective antenna. As with the electric fields, however, there is a precipitous decline in field strength in the region between the two antennas. Again, such a precipitous decline in the magnitude of the magnetic field indicates destructive interference between magnetic fields of the first and second antennas.

Referring to FIG. 4*b*, a comparative view of the magnetic fields for an antenna system in which the feed points are in the same relative position is shown. In this figure, the magnitude of the magnetic field in the region between the first and second antennas is relatively constant and of medium relative strength. Like the electric field in FIG. 3*b*, this is indicative of constructive interference since there is not a decline of magnetic field strength as a function of distance from the antennas in this region.

Therefore, using HFSS, one can determine the strength of the electric and magnetic fields between the two antenna systems, and thereby determine whether there is destructive or constructive interference between the antennas.

In a preferred embodiment, the relative magnitude of the electric field in at least a portion of region between the antennas to that at the center of an antenna is less than −3 db, and preferably less than −4 db. In another preferred embodiment, the electric field magnitude in at least a portion of the region between the antennas is less than 0.4 V/m, and preferably less than 0.3 V/m. In a preferred embodiment, the relative magnitude of the magnetic fields in at least a portion of region between the antennas to that at the center of an antenna is less than −1.5 db and preferably less than −2 db. In another preferred embodiment, the magnetic field in at least a portion of the region between the antennas is less than 0.03 A/m, and more preferably less than 0.02 A/m.

Figure 5:
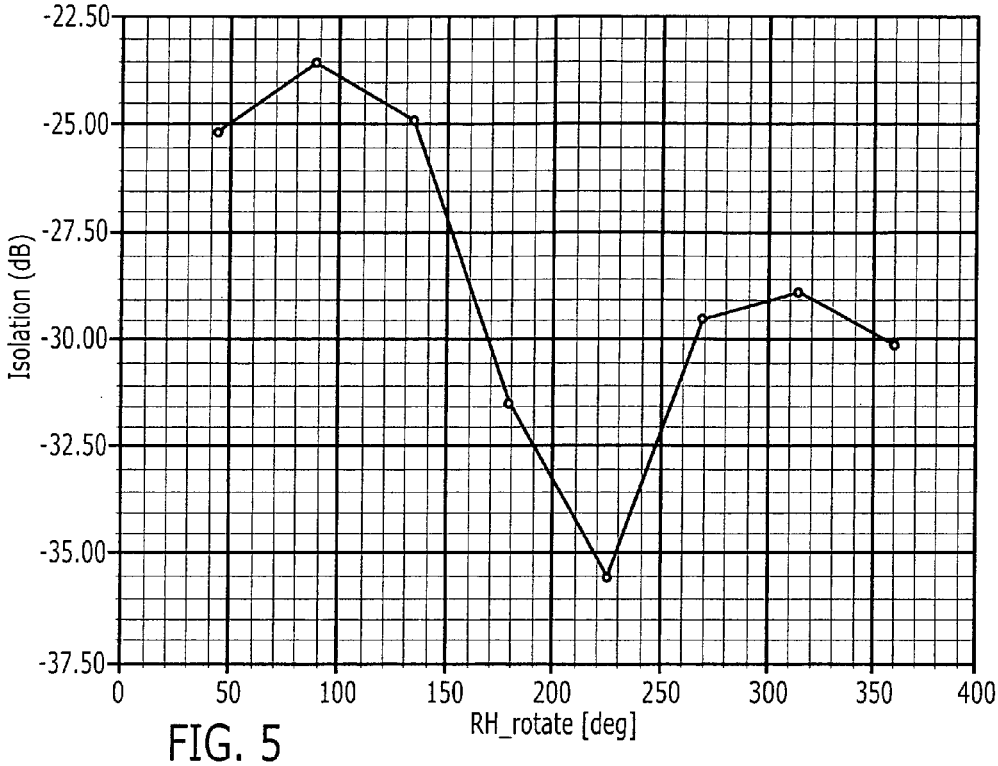
FIG. 5 shows the results of S21 isolation tests for various antenna configurations.

Referring to FIG. 5, a plot of an S21 test for various relative slot positions between the two antennas is shown. As is well known in the art, an S21 test shows the ratio of energy coupled to a receiving antenna over the energy transmitted by the transmitting antenna. For example, if the transmitting antenna transmits 1 watt and the receiving antenna receives 0.001 watt, the S21 isolation is −30 dB or 1/1000. Generally, S21 isolation of less than −30 dB is considered adequate, although some applications may require less. In this case, the second antenna 103 is rotated with respect to the first antenna 102 and various S21 tests were run. In rotating the second antenna, both the antenna and its feed point were rotated together. From this graph it can be seen that the relative positions of the slot and feed point have a profound effect on isolation. Specifically, by positioning the slot so that the second antenna is at an angle of 225° relative to the first, the isolation is less than −35 db. This position corresponds to the relative positions of the antennas shown in FIG. 2. By comparison, when the antennas are configured to a have a relative position of approximately 90°, the isolation is relatively poor—i.e., greater then −25 db. Again, as mentioned above with respect to FIGS. 3 and 4, the low isolation is a result of destructive interference between the two antennas. By having the magnetic and electric fields destructively interfere, the energy between the antennas is reduced to a point where it is not sufficient to couple with the receiving antenna.

By creating opposing electric and magnetic fields in region 104 of the antenna system 100, the antennas may be placed close together without the need for partitions such as those used in the antenna system offered by Thing Magic (discussed above), although, in certain embodiments, it may be preferable to add partitions to further enhance isolation or reduce the space between the antennas. Preferably, the ratio of the distance between the center points 108*a*, 108*b* of the first and second antennas, and the diameter of the first antenna is no more than 3:1, and, more preferably, no more than 2:1. (Note: in the preferred embodiment, as described herein, the antennas are the same size, in which case either diameter can be used in this determination.)

The opposing electrical and magnetic fields depends, in large part, on the feed point of the coaxial cable on the patch antenna and the position of the slot. More specifically, the transmit and receive circuitry is connected to the patch antennas via a coaxial cable which is terminated at a feed point on each patch antenna. The slot is critical for establishing circular polarization which is the preferred polarization (discussed below). The arrangement of the feed point and slot on the antenna establishes the antenna's electromagnetic field pattern, which, in turn, creates the electromagnetic field density or magnitudes described above.

Applicants have found that by positioning the feed points in essentially opposing positions on each patch antenna, opposing electromagnetic field patterns are established on the antennas' surface. As used herein, the term "opposing positions" refers to a relative position of two points on a symmetrical surface having a center in which the points are located on an imaginary line running through the center, at opposite sides of the center, and at an equal distance from the center. It should be understood that both points need not be on the same surface (indeed, in the antennas of the present invention, they are not), but rather, on a similar surface in which the imaginary line is in the same position relative to both surfaces. For instance, referring to FIG. 2, the first and second feed points 107*a*, 107*b* are located on lines 120*a* & 120*b*, respectively, at equal lengths from but opposite sides of the centers 108*a*, 108*b*. (Note: although the feed points are on different antennas, lines 102*a* & 102*b* are in essentially the same position relative to their respective antennas, thereby allowing a comparison of the first and second feed points.)

The use of the term "essentially" in describing the opposing positions of the feed points recognizes that the positions may not be absolute. More specifically, to impedance match the two antennas, the feed point of the antennas may need to be adjusted. For example, to match the impedance to 50 ohm, one feed point may be +/−1/10 in. (100 mils) from a true opposing position. The amount of adjustment is related to the antenna diameter which, in turn, is related to the operating frequency of the system. As used in this context, the term "essentially" therefore refers to a position differing from a true opposing position by no more than 2% of the antennas diameter. For example, if the antenna diameter is 6.03 in. (suitable for 915 MHz), then a feed point can be moved by up to about 120 mils from its true opposing position and still be in an essentially opposing position. This allowable adjustment is referred to herein as the "tolerance window."

The position of the feed points may also be described in terms of a Cartesian coordinate system. More specifically, referring to FIG. 2, the antenna base 105 is elongated and has x and y axes with the x axis running along the length of the antenna platform. For purposes of description, the center 108*a* of the first planar antenna 102 can be assumed to be at position −x', y' and the center 108*b* of the second planar antenna 103 can be assumed to be at position x', y', where y' is equal to 0, and the point along the x axis between the centers 108*a*, 108*b* is equal to 0. Using this convention, either the first feed point 107*a* is at position −x", −y", and second feed point 107*b* is at position x", y"± the tolerance window, or, as shown in FIG. 2, the first feed point 107*b* is at position −x", y", and second feed point 112 is at position x", −y"± the tolerance window. It should be understood that these positions are relative to the antenna base 105 only.

In addition to the position of the feed points, applicants have found that the placement of the slot in each antenna is important. Specifically, the slots 106*a*, 106*b* are preferably orthogonal to each other as shown in FIG. 2. With the respect to the Cartesian coordinate system, this means that one slot has a slope of x'''/y''', and the other has a slope of about −x'''/y'''. In a particularly preferred embodiment, the slots are at about a 45° angle with respect to the x axis, or, in terms of the Cartesian coordinate system described above, x'''/y''' is equal to about 1.

Aside from the relative position of the feed points and slots, the antennas have a conventional configuration. Although there are many suitable antennas for performing RFID functions, including, for example, parabolic dishes, rectangular waveguide horns, or planar antennas, of particular interest herein are the planar antennas. Suitable, commercially-available slot-fed planar antennas are available, for example, from M/A Com (Lowell, Mass.) and Symbol.

Planar antennas can be developed with various polarizations, including right-hand circular polarization (RCP), left-hand circular polarization (LCP) and linear polarization (LP). In one embodiment, the tag uses a linear polarized (LP) quarter wavelength patch antenna. The tag, which is mounted on a moving item such as a pallet, changes its orientation continuously, thus making alignment of the antenna orientation, which is directly related to the polarization, a difficult task. Circular polarized antennas are more tolerant of the tag orientation.

Figure 6:
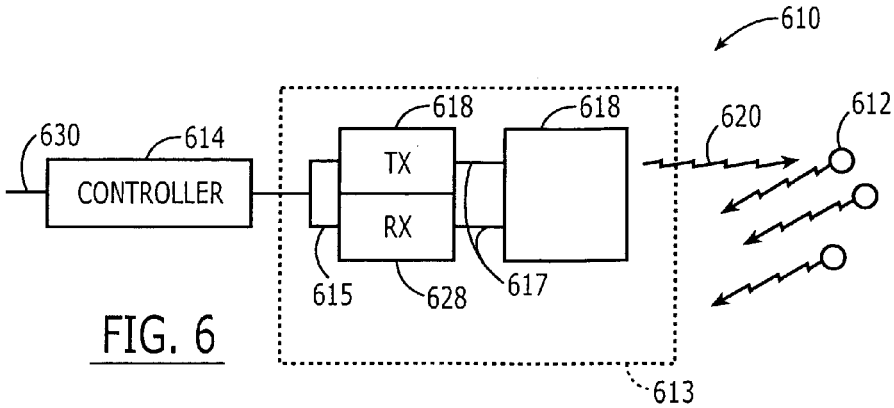
FIG. 6 shows a schematic of radio frequency identification system using the antenna system of the present invention.

Referring to FIG. 6, an RFID system 610 incorporating the antenna system of present invention is shown schematically. It should be understood that the antenna system of the present invention can be used with a known or later-developed RFID system. The system 610 includes an interrogator 613 operating in response to commands from a controller 614. Data and commands are exchanged between the interrogator 613 and the controller 614 through interconnections 615. In one mode of operation, a transmitter TX 616 contained in the interrogator 614 supplies signals through interconnections 617 to a transmit/receive (T/R) antenna system 618. The T/R antenna system 618 is configured in accordance with the system shown in FIG. 1 described above.

The T/R antenna system 618 in turn radiates an interrogation signal 620 to one or more of the transponding modules 612. When the interrogation signal 620 is received by one of the transponding modules 612, a response signal 624 may be generated and transmitted. The response signal 624 typically includes modulation allowing some property or set of properties of the transponding module 612 to be determined.

The response signal 624 is received by the antenna system 618 and is coupled to a receiver RX 628. The receiver RX 628 demodulates the received response signal 624 and supplies information determined from the received response signal 624 to the controller 614 via the interconnections 615. The controller 614, in turn, may be able to supply information derived from the response signal 624 to an external processor (not illustrated) via a bus or other data link 630.

Similar kinds of systems are presently of great interest for identifying, sorting, counting and routing in situations where selected objects in a population of objects require individual recognition and treatment. Examples include luggage-handling and routing systems associated with public or private transportation systems, package handling and routing systems, vehicle or other rental or check-out systems and inventory control systems. Some kinds of systems 610 may interrogate a large number of transponding modules 612 simultaneously. For example, an inventory control system may be used to determine if a specific item coupled to the target transponding module 612 is contained in a warehouse. Typically, each transponding module 612 is associated with an inventory item in the warehouse and vice versa.

In these types of systems, code division multiple access may be used to discriminate between responses from multiple transponding modules 612. Alternatively, a preamble including a code or serial number unique to the desired target transponding module 612 may be transmitted by the interrogator 613, and only the target transponding module 612 responds to the interrogation signal 620.

Other schemes include: (i) transmitting interrogation signals 620 from the interrogator 613 to a group of responding target transponding modules 612; (ii) distinguishing some response signals 624 from the group of target transponding modules 612; (iii) transmitting signals from the interrogator 613 to turn "off" those transponding modules 612 identified from the response signals 624; (iv) iterating steps (i)-(iii) until the desired target transponding module 612 has been identified and interrogated; and then (v) transmitting signals from the interrogator 613 to restore the ensemble of transponding modules 612 to their initial status or any other desired status. Other methods for selecting one or more target transponding modules 612 in a population of transponding modules are known as well.

What is claimed is:

1. An antenna system comprising:

a base;

a first patch antenna disposed on said base and having a circular polarization and adapted to convert between electrical signals and electromagnetic fields; and a second patch antenna disposed on said base and having a circular polarization and adapted to convert between electrical signals and electromagnetic fields, said second antenna being disposed at a distance from said first antenna to define a region between said first antenna and said second antenna, said second patch antenna being oriented relative to said first patch antenna such that electric and magnetic fields of the two antennas are substantially opposing in said region.

2. The antenna system of claim 1, wherein said system has an axis that runs through the center of said first and second antennas, and wherein each antenna has a slot to impart circular polarization to said electric and magnetic field, the slot of said first antenna being orthogonal to the slot of said second antenna, and wherein said first antenna has a first feed point at a first position and said second antenna has a second feed point at a second position, said first and second positions being located on different sides of said axis.

3. The antenna system of claim 2, wherein said slots are at about a 45-degree angle to said axis, and said feeds are aligned with the center of their respective antenna along an imaginary line perpendicular to said axis.

4. The antenna system of claim 2, wherein the circular polarization of one of said first and second antennas is clockwise, and the other of said first and second antennas is counterclockwise.

5. The antenna system of claim 2, wherein said antennas are essentially the same size and shape.

6. The antenna system of claim 2, wherein said first antenna has a diameter, and wherein the ratio of said distance to said diameter of is no greater than about 3:1.

7. The antenna system of claim 1, wherein there are no partitions in said region.

8. The antenna system of claim 1, wherein said antenna system has an S21 isolation of less than −30 db.

9. The antenna system of claim 1, wherein the electric field in said region compared to that at the center of the first antenna is less than −3 db, and the magnetic field in said region compared to that at the center of the first antenna is less than −1.5 db.

10. An antenna system comprising:

a base a first patch antenna mounted on said base and comprising a first circular surface defining a first slot and being capable of transmitting a circularly polarized signal, said first patch antenna comprising a first feed point at a first position within said first circular surface; and a second patch antenna mounted on said base comprising a second circular surface defining a second slot orthogonal to said first slot, and being capable of receiving a return signal from a tag, said second circular surface being about the same size as said first circular surface, said second patch antenna comprising a second feed point in a second position on said second circular surface;

wherein said system has an axis that runs through the center of said first and second antennas, and wherein said first and second positions are located on different sides of the said axis.

11. The antenna system of claim 10, wherein said first and second antennas define a region therebetween and said region is free of partitions.

12. The antenna system of claim 10, wherein said base is elongated and has x and y axes with said x axis running along the length of said base and through the center of said first and second patch antennas, said axis being said x axis, the center of said first patch antenna being at position −x', y' and the center of said second patch being at position x', y', where y'=0, said first and second feed points being located in one of a first or second position scheme, in a first position scheme, said first feed point being at position −x", y", and said second feed point being at position x", −y" within a tolerance window, and, in said second position scheme, said first feed point being at position −x", −y", and said second feed point being at position x", y" within said tolerance window, said tolerance window being no greater than 2% of the diameter of said first antenna.

13. The antenna system of claim 12, wherein one of said first and second antennas has a slot with a slope of x'"/y'", and the other of said first and second antennas has a slot with a slope of about −x'"/y'".

14. The antenna system of claim 10, wherein said first and second patch antennas define a distance between their centers which is no greater than about 3 times the diameter of said first patch antenna.

15. The antenna system of claim 10, wherein said antennas are about the same size and shape except for the position of their respective slots and the position of their feed point.

16. The antenna system of claim 10, wherein either said first or second patch antenna is a transmit antenna and the other is a receive antenna.

17. A radio frequency identification (RFID) system comprising:

a controller;

an interrogator communicatively linked to said controller and comprising at least a transmitter, a receiver, and an antenna system; and said antenna system comprising at least:

a base;

a first patch antenna mounted on said base and connected to said transmitter, said first patch antenna comprising a first circular surface defining a first slot and being capable of transmitting a circularly polarized signal to a tag, and a feed point in a first position within said first circular surface; and a second patch antenna mounted on said base and connected to said receiver, said second patch antenna comprising a second circular surface defining a second slot orthogonal to said first slot, and being capable of receiving a return signal from a tag, said second circular surface being about the same size as said first circular surface, said second patch antenna comprising a feed point in a second position within said second circular surface;

wherein said system has an axis that runs through the center of said first and second antennas, and wherein said first and second positions are located on different sides of the said axis.

18. The RFID system of claim 17, wherein said first and second antennas define a region therebetween and said region is free of partitions.

19. The RFID system of claim 17, wherein said first and second patch antennas define a distance between their centers which is no greater than about 3 times the diameter of said first patch antenna.

* * * * *